United States Patent [19]

Allard

[11] 4,320,619

[45] Mar. 23, 1982

[54] PAYOFF NEUTRALIZER FOR CABLING WIRE AND FIBER STRANDS

[75] Inventor: Joseph R. Allard, Warwick, R.I.

[73] Assignee: The Entwistle Company, Hudson, Mass.

[21] Appl. No.: 137,978

[22] Filed: Apr. 7, 1980

[51] Int. Cl.[3] ..... D01H 13/10; D07B 3/04

[52] U.S. Cl. ..... 57/59; 57/264; 242/128

[58] Field of Search ..... 57/58.38, 58.72, 58.83, 57/58.86, 59, 116, 117, 264; 242/45, 128

[56] References Cited

U.S. PATENT DOCUMENTS

| | | | |
|---|---|---|---|
| 2,944,747 | 7/1960 | Miller | 242/45 |
| 3,275,262 | 9/1966 | Merrill | 242/128 |
| 3,490,222 | 1/1970 | Allard | 57/59 |
| 4,073,127 | 2/1978 | Orlandi et al. | 57/59 |
| 4,135,679 | 1/1979 | Murphy et al. | 242/128 |

*Primary Examiner*—Donald Watkins
*Attorney, Agent, or Firm*—Barlow & Barlow

[57] ABSTRACT

An improved wire or fiber strand payoff neutralizer adapted for multi-position application is described, which permits numerous individual strands of wire or fiber that will be formed into a cable to be payed out linearly and uniformly under controlled and regulated tension to the other components of a cabling machine. The present invention utilizes a split shaft, the reel containing the wire or fiber strand being mounted on an arbor portion of the split shaft, and a flyer being mounted on the driven portion of the rotor shaft. The wire or fiber strands then travel from the product supply reel to the flyer and then back to the hollow core of the rotor shaft and thence to the other components of the cabling system. The flyer and the rotor shaft rotate at the same speed as the other components of the cabling system, as well as in the same direction. A direct current-operated stepper motor drive is directly coupled to an encoder, which receives signals from a secondary linear encoder that is in contact with the payed out wire or fiber strand. The direct current stepper motor drive thus controls the fiber or wire payoff from the product reels in order to provide a predetermined tension and twist to the cable assembly.

12 Claims, 5 Drawing Figures

PAYOFF NEUTRALIZER FOR CABLING WIRE AND FIBER STRANDS

BACKGROUND OF THE INVENTION

The present invention relates to a wire or fiber cabling system and is an improvement over my previous U.S. Pat. No. 3,490,222.

The present invention also relates to a wire or fiber payoff neutralizer for a cabling system.

The present invention also relates to a multi-positionally-adapted wire or fiber payoff neutralizer for a cabling system.

The present invention also relates more specifically to a payoff neutralizer that eliminates the back twist and internal tension in the individual component wire or fiber strands of a completed cable.

The present invention also relates to an apparatus for unwinding coiled cable strand material.

The present invention also relates to a multi-positional wire or fiber payoff neutralizer that is designed for high speed operation, whereby the production of the cabling system is increased considerably.

The present invention more specifically also relates to an apparatus for delivering cable strand material to a moving core under controlled minimum tension from a cable strand supply positioned co-axially with the core.

SUMMARY OF THE INVENTION

An object of the present invention is to provide a payoff neutralizer apparatus for unwinding wire or fiber cable strand material with minimum tension and back twist.

Another object of the present invention is to provide an improved wire or fiber strand payoff neutralizer unit.

Another object of the present invention is to provide an improved wire or fiber strand payoff neutralizer that is suitable for multi-position use.

Still yet another object of the present invention is to provide a wire or fiber strand payoff neutralizer that will eliminate both the back twist and internal strain on the individual component strands to be configured into an assembled cable structure.

Yet another aspect of the present invention is to provide a multi-position wire or fiber payoff neutralizer that is suitable for a high speed cabling operation, thereby allowing the production of the cabling system to be considerably increased.

Another object of the present invention is to provide an apparatus for eliminating the residual back twist and internal tension on the individual cable wire or fiber strands while feeding them at high speeds to the other components of a cabling system.

Another object of the present invention is to provide a payoff neutralizer device incorporating accurate control means for removing the residual twist and for controlling both the tension and the number of twists on the individual cable strands.

Still yet another object of the present invention is to provide a payoff neutralizer that is able to handle a plurality of individual cable components in a minimum of space.

Another object of the present invention is to provide a multi-positional payoff neutralizer that will operate at the desirable higher production speeds of a cabling system, thereby allowing maximum speed of cable manufacture.

A final object of the present invention is to provide a payoff neutralizer apparatus which is both simple in construction and economical to both manufacture and assemble.

To accomplish the above objects, an improved wire or fiber strand payoff neutralizer adapted for multi-position application is described, which permits numerous individual strands of wire or fiber that will be formed into an assembled cable, to be payed out linearly and uniformly under controlled and regulated tension to the other elements of a cabling machine.

The present invention utilizes a split shaft, the reel containing the wire or fiber strand being mounted on an idler portion of the split shaft, and a flyer is mounted on the driven portion of the rotor shaft. The individual wire or fiber strands then travel from the product supply reel to the flyer and then back to the hollow core of the rotorshaft and thence to the other components of the cabling system.

The flyer and the rotor shaft rotate at the same speed as the other components of the cabling system, as well as in the same direction.

A direct current-operated stepper motor drive is directly coupled to an encoder, which receives signals from a secondary linear encoder that is in contact with the payed out wire or fiber strand. The direct current stepper motor drive thus controls the wire or fiber payoff from the product reels in order to provide a predetermined tension and twist to the cable assembly.

DETAILED DESCRIPTION OF THE PREFERRED EMBODIMENT

In the assembly of wire or fiber cable, both structural and electrical, individual component strands are fed from various payoff neutralizer reels to the remaining cabling system components, which then handles the individual strands and arranges them to provide a twist in the completely assembled cable.

As the individual wire or fiber strands are assembled into a finished multi-strand cable, a residual back twist normally results in all the fibers in the cable, this back twist extending rearwardly along the strand. This situation results in an undesired internal strain and stress in the assembled cable, making it stiff and hard to handle, as well as being difficult to coil properly.

In an attempt to eliminate this undesirable, previously ubiquitous cable quality, individual reels of wire or fiber were arranged around the perimeter of a planetary device in the form of a large wheel, which was designed to rotate simultaneously with the unreeling of the strands, from their individual reels. If the planetary feed device is turned in the same direction as the internal twist being imparted to the wire strand, the residual twist in each strand is essentially eliminated.

However, one of the major drawbacks of this prior art technique being that the planetary wire payoff devices are generally limited to a slow speed operation, that is from 40 to 50 rpm (on large size reels, and from 150 to 200 rpm on the small size reels). These operating speeds will perforce materially decrease the speed at which the cabling system can be operated.

The present invention, however, allows for a wire or fiber payoff neutralizing device which eliminates the residual internal twist or strain in the individual conductors or strands of an assembled cable, and further will also allow for a relatively high speed cabling operation.

The device of the present invention is constructed to allow a linear movement of the strands while at the same time eliminating the conventional planetary movement of the payoff reels. This allows for a cabling system that can be operated with large reels at from 400 to 600 rpm, and on smaller reels at 800 to 1000 rpm, with the payoff neutralizer of the present invention allowing the cabling system to be operated as rapidly as from 80 to 100 feet per minute during the cabling assembly.

The present invention utilizes a flyer which is able to rotate at the same speed as the cabling machine. The wire payoff from the wire reels is individually, precisely and accurately controlled, thereby eliminating undesirable fiber or wire internal tension, and providing proper wire or fiber internal tension and twist control. The wire loading time of the present invention is also considerably faster than that for the planetary time, thereby reducing inoperative time.

Figure 1:
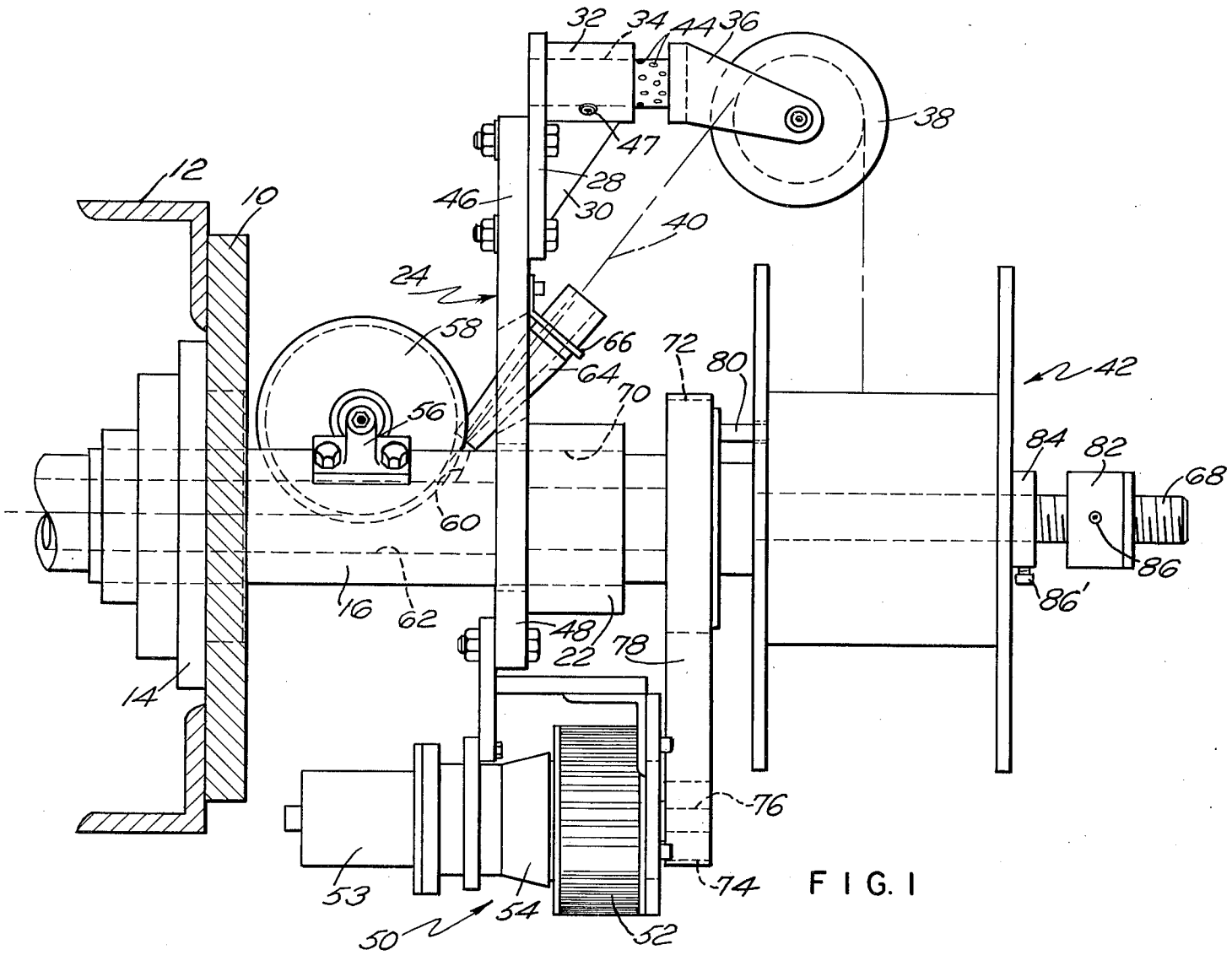
FIG. 1 is a partial side elevational view of one of the payoff neutralizing units of the present invention.
Figure 2:
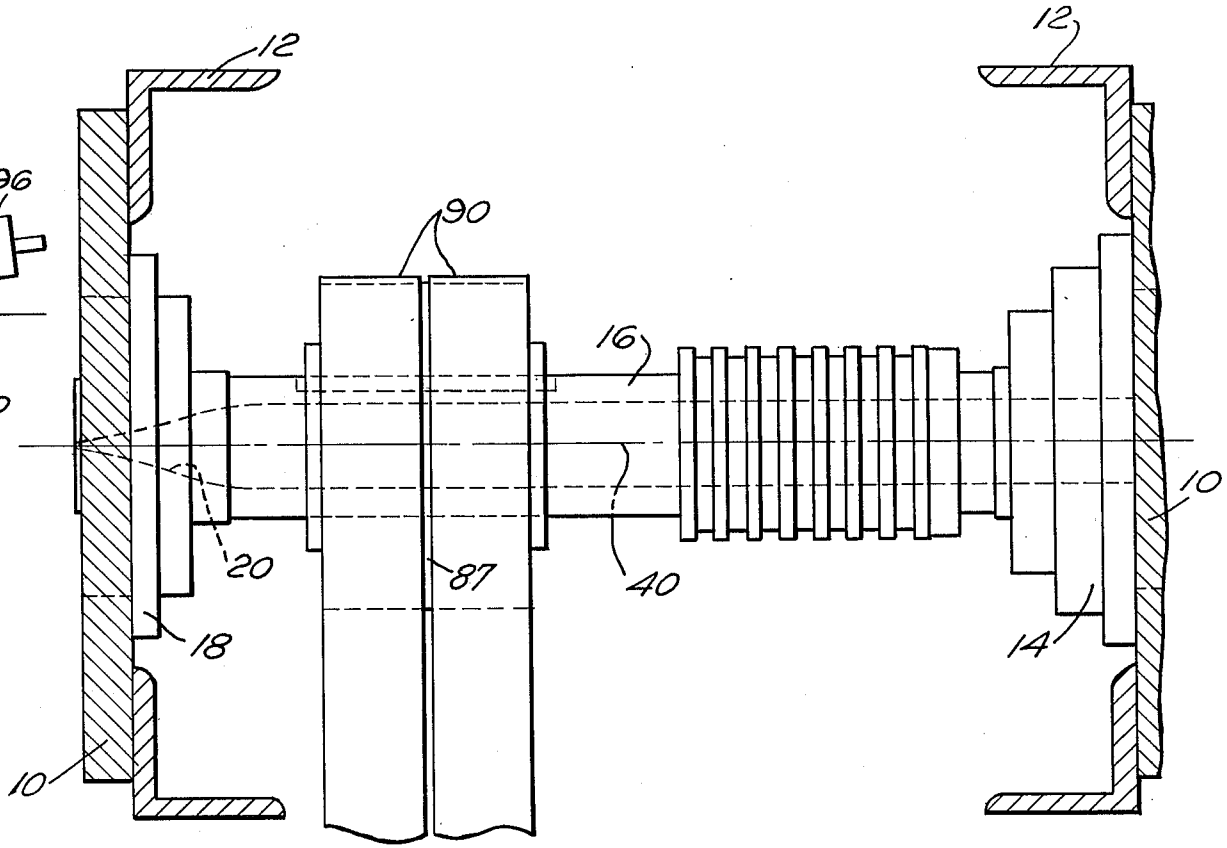
FIG. 2 is the remaining partial side elevational view of one of the payoff neutralizing units of the present invention.

Referring more in detail to the drawings and in particular to FIGS. 1 and 2, which are partial side elevational views of one of the payoff neutralizing units of the present invention, the other payoff units adapted for each individual product reel are identical with this unit, and any number of individual payoff neutralizing units may thus be incorporated into a particularly configured cabling system.

Figure 4:
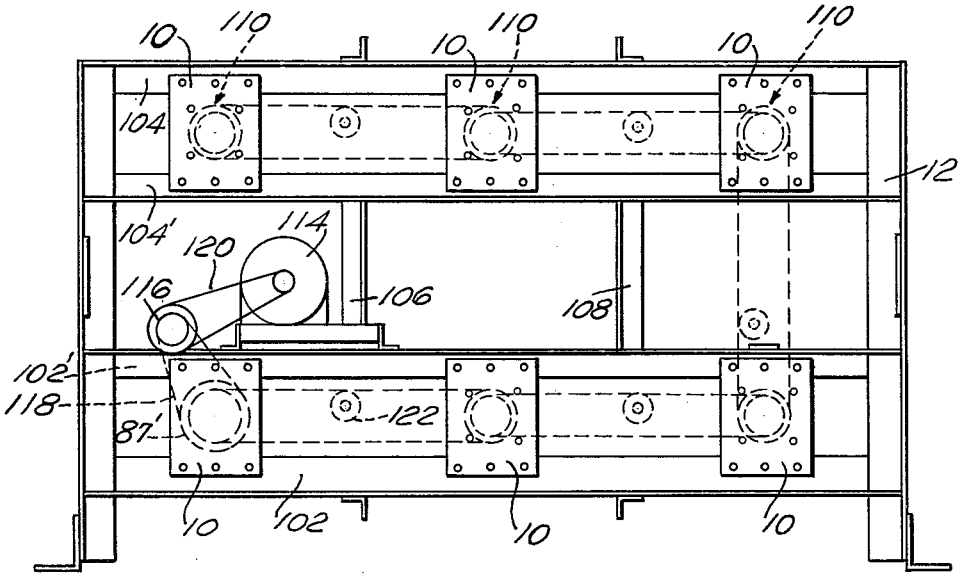
FIG. 4 is a side elevational view of the multiple payoff neutralizer supporting frame showing attached payoff neutralizing units.

Each payoff neutralizing unit comprises a bearing plate 10, which is mounted at one side to a supporting drive frame 12, as shown in FIG. 4. The bearing plate 10 is provided with a large rotor bearing 14 supporting a hollow rotor shaft 16 which extends to the opposite side of support frame 12 into a support bearing 18. The support bearing 18 is further provided with a central opening 20, for a purpose that will be described later on.

The rotor shaft 16 extends through bearing 14 and outwardly of the plate 10 to the left in FIGS. 1 and 2.

Mounted adjacent to the outer end of the rotor shaft 16 is a heavy collar-like rotor hub 22, being integrally attached to a large flyer 24. Flyer 24 is configured in the form of an elongated plate extending at right angles to the rotor shaft 16 and rotor hub 22, comprising both a long section (46) and short section (48) on the opposite sides of rotor shaft 16. The rotor hub 22 is fixably mounted to the rotor shaft 16, so that it rotates along with it. At the end of the long section 46 of the flyer, generally designated 24, a plate 28 is mounted, carrying a bracket 30, extending co-axially with the rotor shaft 16. The bracket 30 carries a cylinder 32, in which a shaft 34 is slidably mounted. The shaft 34 carries a fork member 36 in which a grooved pulley wheel 38 is rotatably mounted.

As the strand of wire or fiber 40 leaves the reel 42 in the device, it must pass over the grooved pulley wheel 38. It is therefore quite essential for flexibility that the said grooved pulley wheel 38 be adjustable to both different sizes and widths of wire and fiber reels 42, and furthermore be angularly adjustable for the requisite direction of rotation. To accomplish this, the shaft 34 is provided with a plurality of depressions 44, oriented in differing angular directions. The cylinder 32 is further provided with a dog pointed screw 47.

The said screw 47 can thus be loosened when required, and the pulley wheel 38 then adjusts outwardly as shown in FIG. 1. After the setting of the pulley wheel 38 the proper distance, and its angle has been determined, the screw 47 is then tightened until the dog point engages one of the depressions 44.

Mounted to the short end 48 of the flyer 24 is a housing generally designated 50, containing a direct current stepper drive motor 52. Attached to a through shaft of the direct current stepper drive motor 52 is an encoder 53 and a d.c. tachometer generator 54.

Mounted on the rotor shaft 16 between the flyer 24 and the bearing plate 10, is a supporting bracket 56, on which a grooved pulley wheel 58 is rotatably mounted. This pulley wheel 58 extends in through a guide slot 60 to the center core 62 of the hollow rotor shaft 16. A tapered guide tube 64 is angularly mounted on the flyer 24 with its smaller end adjacent to the grooves of the pulley wheel 58, and its larger end retained in a bracket 66 mounted on the side of the flyer longer arm 46.

An arbor shaft 68 is mounted inbearings 70 located at the end of the hollow rotor shaft 16. This arrangement allows independent rotation of the hollow rotor hub 22, and the contiguously oriented arbor shaft 68. Adjacent to the bearing 70 of the arbor shaft 68, there is provided a driven drum 72. This driven drum 72 is directly located above a motor drum 74, mounted on a shaft 76 extending from the direct current operated stepper motor drive 52. A continuous belt drive 78 extends around the drums 72 and 74. The drum 72 is also provided with a laterally extending drive pin 80 which engages the side of the wire reel 42 side plate when the reel 42 is mounted in position on the arbor shaft 68. The reel 42 is thus held in position on the arbor shaft 68 against the drive pin 80 by means of a pair of split locking collars 82 and 84 with releasable set screws 86, 84' for tightening the split collars into position on the arbor shaft 68. Speeding up of the motor (52) occurs as the reel (42) unwinds, which maintains a constant unwind speed as the core size decreases in a manner to be presently described.

Referring again to FIGS. 1 and 2, as the wire 40 leaves the wire reel 42 and travels vertically out and at right angles to the grooved pulley wheel 38, the wire 40 travels over and around pulley wheel 38 and then continues into and through wire guide tube 64, then continuing beneath the pulley wheel 58.

The wire 40 now passes partially through the rotor shaft 16, actually passing into and through the hollow core center 62 of the line shaft 16, then out through the opening 20 on the opposite side of the support frame 12.

At this point in the sequence, the wire 40 can be routed directly on to the other cabling machine components. However, where the cabling machine is positioned at an angle to the side of frame 12, an additional guide pulley wheel may be optionally mounted in a bracket located near the outside of the support bearing 18 opening 20, so that a wire 40 can extend around this optional grooved pulley wheel, and then travel on to the other cabling machine components.

With the arrangement of parts hereinabove described, the wire 40 is also partially drawn into the cabling machine by the operation of the other cabling machine components. This, in turn, drives the wire reel 42, causing both it and the idler shaft 68 to rotate. Simultaneously, the rotor shaft 16 is driven through a sprocket wheel 87 and timing belt drive 90 at the same speed and in the same direction as the other cabling machine components. It is to be understood that the speed of the rotor shaft 16 may be adjusted during cabling operations in order to conform to the operating speed of the other cabling machine components.

The controlled rotation of the rotor shaft 16 will likewise cause rotation of the flyer 24 attached to the rotor shaft 16. This will then result in the strand of wire or fiber 40, which passes over and around the grooved pulley wheel 38 on the flyer 24, to be given an internal twist as it leaves the wire reel 42 in the same direction as the cabling machine, thus eliminating the residual back twist in the wire 40.

It is anticipated that the cabling machine will operate at speeds of from between 400 to 600 revolutions per minute, thus giving the individual strands of wire or fiber 400 to 600 twists per minute, and a linear speed of from 80 to 100 feet per minute, versus five linear feet per minute of the earlier systems. By rotating the rotor shaft 16 and the flyer 24 at the same speed and in the same direction, the residual internal twist in the individual wire or fiber strands is eliminated. However, the wire reel 42 is being partially driven by the pull of the wire 40, and the number of twists per foot is controlled by both the relationship between the speed of the cabling machine components, and the linear speed of the wire traveling through it. Furthermore, the wire must be at the proper tension. To this end, the direct current-operated stepper motor drive 52 in conjunction with its received control signals derived from the adjacent encoder 53 acts as a brake on the reel 42. As the flyer 24 and the flyer-mounted direct current stepper motor drive 52 both rotate simultaneously, the timing belt 78 connected from the clutch drum 74 to the drum 72 on the arbor reel shaft 68 also rotates. The direct current stepper motor drive 52 can then be operated to provide a controlled let-off on the reel arbor shaft 68 and the wire reel 42, in order to provide the necessary wire tension control as well as the wire twist control.

Figure 3:
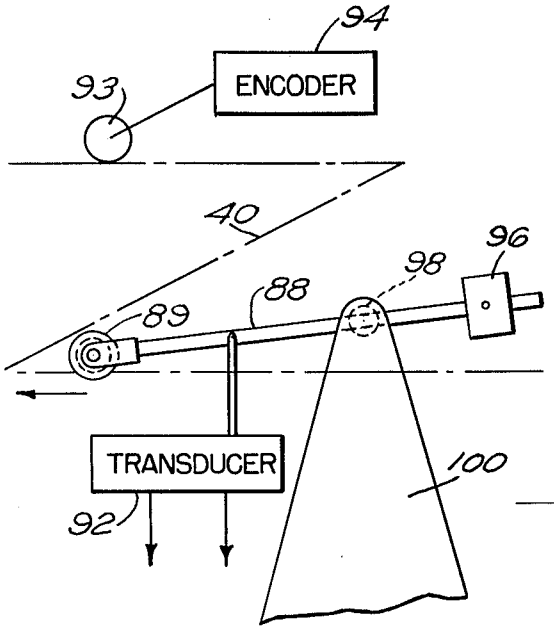
FIG. 3 is a diagrammatic view of the wire tension transducer unit of the present invention.

FIG. 3 is a schematic view of the wire tension transducer unit of the present invention. Located between the payoff neutralizer unit of the present invention and the capstan unit component of the cabling system, is an elongated rod-like, lightweight, cantilevered arm 88, pivoted at pivot point 98 located at the apex of a triangular-shape bracket 100. This cantilevered arm 88 incorporates a nylon grooved wheel 89 rotatably mounted at one end of the arm 88, the wheel 89 riding on top of the payed out individual wire or fiber strand 40. The internal tension and displacement of this payed off wire strand 40, in turn, raises or lowers this pivoted cantilevered arm 88. This then results in tension control being imparted to the moving wire product reel 42, by means of transducer 92. In addition, wire line speed is sensed by a wheel 93 coupled to an encoder 94. Wire or fiber tension control settings can be previously selected by means of a finely adjustable counterbalance weight 96 located at one end of the cantilevered dancer arm 88. Preset wire or fiber tension settings in the range of from 20 to 100 grams may be precisely adjusted by these means.

In order to feed the individual strands of wire or fiber product to the cabling machine components, any number of the units hereinabove described may be employed. A suitable supporting frame will be provided in order to hold the necessary number and configuration of these single payoff neutralizer units.

Figure 5:
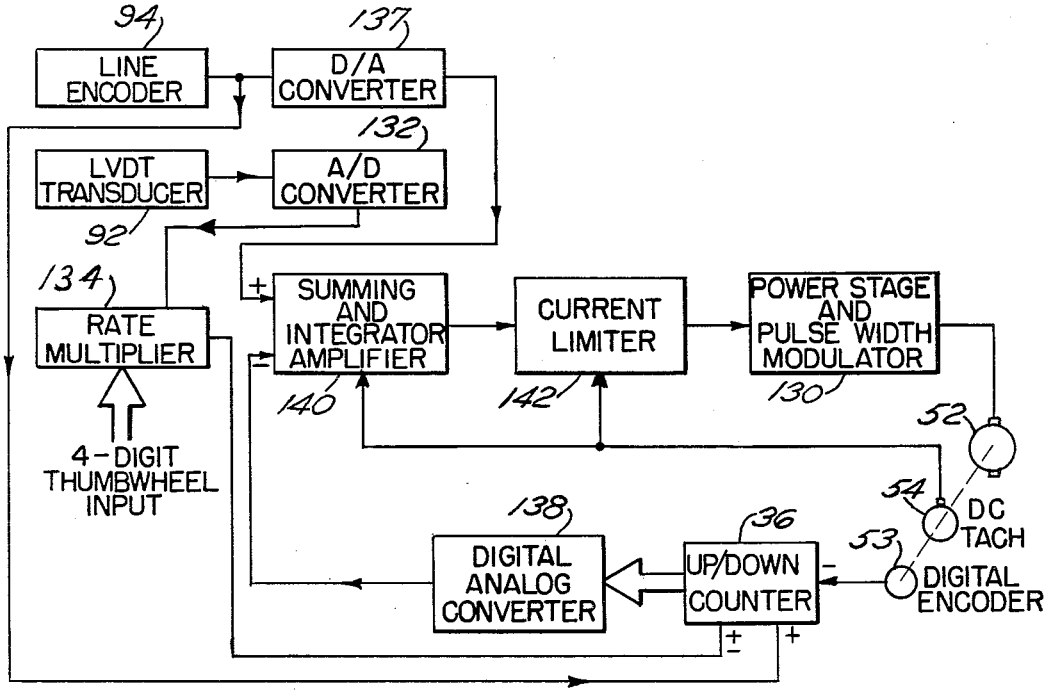
FIG. 5 is a schematic block diagram of the control circuitry for the invention.

In order to understand how the stepper motor 52 operates to control the tension and unwinding of the reel 42, reference should be had to FIG. 5 of the drawings. Essentially, the stepper motor 52 is powered by a pulse width modulator which includes a power stage which is designated by the block 130, it being understood that the motor 52 is preferably one that has low inertia and low inductance and is a type that is known in the trade as a pancake motor. In order to provide a signal to the pulse width modulator 130, there is a first signal that is responsive to line tension generated by transducer 92 which may conveniently be a linear voltage differential transformer that has an analog output that is converted to digital output by converter 132, the digital output thereof being fed to a rate multiplier 134. The rate multiplier 134 which is controlled by a four-digit thumb wheel input is used to reduce the pulse rate frequency in accordance with the thumb wheel setting and in effect selects the desired tracking ratio. The output of the rate multiplier is then fed to an up/down counter 136 and may be either + or − in sense. The main command signal is generated by a digital line encoder 94 responsive to linear line speed. The signal is converted to analog at 137 and fed to summing and integrator amplifier 140. In addition, the digital output of encoder 94 is fed to up/down counter 136. Essentially the counter yields an error signal between motor shaft rotation and command inputs. This error is converted to an analog signal at 138 which is summed with the line encoder 94 signal. The signals which are now effectively the command and error signals appearing at the input of the summing and integrator amplifier 140, are further modified by the d.c. tachometer 54 feedback signal where, in effect, the motor drive signal is modified by the difference between the command and error signals at the input of the summing amplifier 140 and the tachometer feedback signal. It is essential to limit the drive signal to the pulse width modulator 130, and for that purpose a current limiter 142 is inserted into the drive line.

It will be apparent that encoder 53 effectively yields a positional correction signal which is obtained by the utilization of an up/down counter 136 which, by counting command pulse transitions in negative sense and the digital line encoder output in another or positive sense, coupled with a tracking ratio correction in either sense, yields an accurate measure of the error between the command steps and the actual shaft motion. In essence, with this control system the line encoder 94 senses the wire line speed so that unwinding occurs at the proper rate. The transducer 92 senses the tension on the line to correct the stepper motor operation in accordance with a predetermined tension that can be modified by the four-digit thumb wheel input that is associated with the rate multiplier 134. In effect, the stepper motor speed may be varied during unwind and it maintains proper reel surface speed and payoff tension at all times.

In FIG. 4, which is a side elevational view of the multiple payoff neutralizers mounted on a supporting frame showing the attached payoff neutralizer units, we see there illustrated an integrated drive mechanism for six separate payoff neutralizing units on an integral frame 12.

The frame 12 is provided with suitable horizontal supporting angle irons 102, 102' and 104, 104', as well as suitable vertical supporting irons 106 and 108. A possible preferred configuration of six individual payoff neutralizing units generally designated 110, with three located above three lower payoff neutralizing units, is shown in FIG. 4.

The lower bearing plates 10 are shown mounted on the twin horizontal angle irons 102, 102' and are further appropriately spaced so that the vertical angle irons 106 and 108 extend vertically between them. The upper mounted row of payoff neutralizer units 110 are arranged so that their twin bearing plates 10 are mounted on the horizontal angle irons 104, 104' situated above the lower payoff neutralizer units. Each rotor shaft 16 utlizes a double sheave 87 (see FIG. 2). Power drive is provided by means of a large motor 114 driving the small sprocket wheel 116 by means of a sprocket chain 120. The sprocket wheel 116 is connected by means of a drive belt 118 to the sheave 87 situated on the rotor shaft 16, shown immediately below it to the left in FIG. 4.

The drive is imparted by the series of belts from sheaves 87 on the next shaft to the right, and then back over the idler 122, which is vertically adjustable on the vertical angle iron 106. The idler 122 is vertically adjustable in order to take out the slack in the drive. Similarly, we find that the drive runs from the central lower shaft to the outer shaft to the right, and from there upwardly to the upper shaft to the right, and from the upper right shaft to the upper central shaft, and then finally from the upper central shaft to the upper shaft to the left. Thus, each set of belts passes over two rotor shafts.

The above-described drive provides for a simultaneous drive of a plurality of rotor shafts 16, all at the same speed. Further, the tension control on the individual strands of wire or fiber 40 may be either simultaneous, or else individually controlled at each rotor shaft 16.

It is shown that by passing the individual wire or fiber strand 40 linearly through the hollow core 62 of the rotor shaft 16, the need for large awkward rotation of a multiplicity of wheels has been eliminated. The speed of the operation of the individual payoff neutralizer units is only limited by the speed at which the flyer 24 may be rotated. We find that by driving the flyer 24 from between 400 and 600 revolutions per minute, the same speed as the cabling machine, the resultant cable is formed without internal strain, and the individual strands are free of residual twist. The cable, therefore, will lie straight and will coil easily without back twisting.

While the invention has been described in connection with a preferred embodiment, it is understood that I do not intend to limit the invention to that embodiment. On the contrary, I intend to cover the alternatives, modifications, and equivalents as may be included within the spirit and scope of the invention as defined by the appended claims.

I claim:

1. A payoff neutralizer that is designed for use in a wire or fiber cabling machine comprising in combination:

a support means;

a hollow rotor shaft rotatably mounted in said support means;

a flyer rotatably mounted adjacent to one end of said rotor shaft;

a means for rotatably mounting a reel of wire or fiber in axial alignment with the end of said rotor shaft;

the wire strand traveling from the said reel to the said flyer and then into and through said hollow rotor shaft to a cabling machine;

a means for rotating the said rotor shaft at different speeds;

a means for controlling the speed and tension of the wire or fiber leaving the reel;

a means for monitoring the wire tension of the wire or fiber prior to cabling;

means for monitoring the speed of the wire or fiber prior to cabling;

means for correlating the speed and tension of the wire or fiber leaving the said reel.

2. A payoff neutralizer as defined in claim 1, further comprising:

said reel mounting means utilizing a bearing mounted in the end of said rotor shaft;

an auxiliary shaft in co-axial alignment with said shaft;

said shaft having rotation independent of said auxiliary shaft;

a reel mounted on said auxiliary shaft;

a movable collar mounted on said auxiliary shaft for locking said reel against said drum and said auxiliary shaft;

means for rotating said reel and said auxiliary shaft.

3. A payoff neutralizer as defined in claim 1 wherein the said shaft and said flyer are both rotated in the same direction and at the same speed as the other components of a cabling system.

4. A payoff neutralizer as defined in claim 2 wherein said reel and said auxiliary shaft rotating means is precisely adjustable for controlling both the speed and the internal tension of the wire or fiber leaving said reel.

5. A payoff neutralizer as defined in claim 2 wherein the means for controlling the speed and tension of the wire or fiber leaving the reel comprises a direct current stepper motor drive with an attached encoder, mounted at one end of said flyer, and further connected by means of a timing belt to said shaft.

6. A payoff neutralizer as defined in claim 5 wherein said wire tension monitoring means enables signals regarding wire tension to be transmitted to the said encoder.

7. A payoff neutralizer as defined in claim 5 wherein the direct current motor stepper drive, and the encoder in combination, provide a means for regulating both the speed and linear internal tension of the wire or fiber leaving the product reel.

8. A payoff neutralizer as defined in claim 6 wherein said control signals from said wire tension monitoring means provides information to said direct current stepper motor drive via said encoder in order to control both the speed and tension of the wire or fiber leaving the product reel.

9. A payoff neutralizer as defined in claim 1 wherein said flyer and said shaft are both rotated in the same direction and at the same speed.

10. A payoff neutralizer as defined in claim 1 wherein a plurality of said payoff neutralizer units are serially mounted in a configuration thereby allowing the driving means to drive the plurality of shafts simultaneously.

11. A payoff neutralizer as defined in claim 6 wherein the wire tension monitoring means is adjustably responsive to a variable range of wire and fiber tensions.

12. A payoff neutralizer as defined in claim 11 wherein the wire tension is continuously adjustable in a range varying from 20 to 100 grams.

* * * * *